US010178728B2

(12) United States Patent
Li

(10) Patent No.: US 10,178,728 B2
(45) Date of Patent: Jan. 8, 2019

(54) DIRECT CURRENT NEGATIVE DIMMING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Wendong Li, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/552,272

(22) PCT Filed: Mar. 29, 2017

(86) PCT No.: PCT/CN2017/078633
§ 371 (c)(1),
(2) Date: Aug. 19, 2017

(87) PCT Pub. No.: WO2018/152924
PCT Pub. Date: Aug. 30, 2018

(65) Prior Publication Data

US 2018/0332679 A1 Nov. 15, 2018

(30) Foreign Application Priority Data

Feb. 21, 2017 (CN) ..... 2017 1 0093875

(51) Int. Cl.
*H05B 33/08* (2006.01)
*G09G 3/34* (2006.01)

(52) U.S. Cl.
CPC ..... *H05B 33/0845* (2013.01); *G09G 3/3406* (2013.01)

(58) Field of Classification Search
CPC ..... G09G 3/006; G09G 2300/06; G09G 2300/0895; G09G 2310/0262;
(Continued)

(56) References Cited

U.S. PATENT DOCUMENTS

2012/0062148 A1* 3/2012 Kim ..... H05B 33/0815 315/297

FOREIGN PATENT DOCUMENTS

CN 102325401 A 1/2012
CN 102833916 A 12/2012
(Continued)

*Primary Examiner* — Wei Chan
(74) *Attorney, Agent, or Firm* — Andrew C. Cheng

(57) ABSTRACT

Provided is a direct current negative dimming circuit, comprising a first electrical switch, a second electrical switch and first to third resistors, a control end of the first electrical switch is connected to a dimming signal output end of a main chip to receive the first dimming signal, and a first end of the first electrical switch is connected to a voltage end to receive a first high voltage level signal, and a second end is connected to a control end of the second electrical switch, and a first end of the second electrical switch is connected to a dimming signal receiving end of a backlight module to output the second dimming signal, and a second end receives a second high voltage level signal, and a voltage level of the first dimming signal is opposite to a voltage level of the second dimming signal.

15 Claims, 1 Drawing Sheet

(58) Field of Classification Search
CPC ..... G09G 2310/0237; G02F 1/1309; G01R 31/44; H05B 33/0857; H05B 33/0845
USPC ..... 315/392, 169.2, 169.4; 345/102, 87, 84, 345/55, 30, 1
See application file for complete search history.

(56) References Cited

FOREIGN PATENT DOCUMENTS

| | | | |
|---|---|---|---|
| CN | 103310740 | A | 9/2013 |
| CN | 105282907 | A | 1/2016 |
| EP | 2843650 | A1 | 3/2015 |
| KR | 20130015852 | A | 2/2013 |

* cited by examiner

DIRECT CURRENT NEGATIVE DIMMING CIRCUIT AND LIQUID CRYSTAL DISPLAY DEVICE

CROSS REFERENCE

This application claims the priority of Chinese Patent Application No. 2017100938754, entitled "Direct current negative dimming circuit and liquid crystal display device", filed on Feb. 21, 2017, the disclosure of which is incorporated herein by reference in its entirety.

FIELD OF THE INVENTION

The present invention relates to a display technical field, and more particularly to a direct current negative dimming circuit and a liquid crystal display device.

BACKGROUND OF THE INVENTION

LCD TV at this stage at present, there are two ways of dimming for liquid crystal display televisions. One is direct current dimming and the other is PWM dimming. The PWM dimming causes the current flowing through the LED string constantly turning on and off through the high-frequency switch. By controlling the duty ratio of the light string conduction, the brightness adjustment can be achieved. Thus, in the PWM dimming process, the LED light-emitting diode actually keeps flashing. In order to avoid the recognition range of the human eye, the TV manufacturers generally raise the dimming frequency up to 100 Hz or more. The DC dimming achieves dimming with the linear adjustment of the current of the LED string. There is no switch in the DC dimming and no-flicker dimming can be realized. Most of the LED driving chips with analog dimming capability require DC positive dimming (dark at low voltage level and bright at high voltage level). However, for a portion of television main chips, the DC negative dimming (bright at low voltage level and dark at high voltage level) is more conducive to the system design. However, the main chip dimming signal cannot be directly supplied to the LED backlight control chip, which cannot meet the requirements of the TV system to the DC negative dimming.

SUMMARY OF THE INVENTION

An objective of the present invention is to provide a direct current negative dimming circuit for meeting the requirements of the TV system to the direct current negative dimming.

Another objective of the present invention is to provide a liquid crystal display device.

For realizing the aforesaid objective, the technical solution provided by the embodiments of the present invention is:

The present invention provides a direct current negative dimming circuit, applied in a liquid crystal display device to convert a first dimming signal outputted from a main chip of the liquid crystal display device into a second dimming signal and to output the same to a backlight module, characterized in that: the direct current negative dimming circuit comprises a first electrical switch, a second electrical switch, a first resistor, a second resistor and a third resistor, and a control end of the first electrical switch is connected to a dimming signal output end of the main chip through the first resistor to receive the first dimming signal, and a first end of the first electrical switch is connected to a voltage end through the second resistor to receive a first high voltage level signal, and a second end of the first electrical switch is connected to a control end of the second electrical switch, and a first end of the second electrical switch is connected to a dimming signal receiving end of the backlight module to output the second dimming signal to the dimming signal receiving end, and the first end of the second electrical switch is also grounded through the third resistor, and a second end of the second electrical switch receives a second high voltage level signal, and a voltage level of the first dimming signal is opposite to a voltage level of the second dimming signal.

The direct current negative dimming circuit further comprises a fourth resistor and a fifth resistor, and the fourth resistor and the fifth resistor are connected in series between the voltage end and a ground, and the second end of the second electrical switch is connected to a node between the fourth resistor and the fifth resistor to receive the second high voltage level signal.

The direct current negative dimming circuit further comprises a sixth resistor, and the first end of the first electrical switch is connected to the dimming signal output end of the main chip through the sixth resistor.

The direct current negative dimming circuit further comprises a capacitor, and the capacitor is connected in parallel at two ends of the third resistor.

The first electrical switch is a PNP type triode, and the second electrical switch is an NPN type triode, the control end, the first end and the second end of the first electric switch and the control end, the first end and the second end of the second electric switch respectively are a base, an emitter and a collector.

A voltage of the first high voltage level signal is less than or equal to a voltage of the first dimming signal when the first dimming signal is at a high voltage level.

A resistance of the second resistor is less than a resistance of the first resistor.

The present invention further provides a liquid crystal display device, characterized in comprising a main chip, a backlight module, and the aforesaid direct current negative dimming circuit.

The liquid crystal display device is a liquid crystal display television.

The embodiments of the present invention have advantages or benefits:

The direct current negative dimming circuit of the present invention is applied in a liquid crystal display device to convert a first dimming signal outputted from a main chip of the liquid crystal display device into a second dimming signal and to output the same to a backlight module, and the direct current negative dimming circuit comprises a first electrical switch, a second electrical switch, a first resistor, a second resistor and a third resistor, and a control end of the first electrical switch is connected to a dimming signal output end of the main chip through the first resistor to receive the first dimming signal, and a first end of the first electrical switch is connected to a voltage end through the second resistor to receive a first high voltage level signal, and a second end of the first electrical switch is connected to a control end of the second electrical switch, and a first end of the second electrical switch is connected to a dimming signal receiving end of the backlight module to output the second dimming signal to the dimming signal receiving end, and the first end of the second electrical switch is also grounded through the third resistor, and a second end of the second electrical switch receives a second high voltage level signal, and a voltage level of the first dimming signal is opposite to a voltage level of the second dimming signal. Therefore, the first dimming signal of the main chip can be directly provided to the backlight module after being converted to the second dimming signal, thereby satisfying the requirements of the liquid crystal display device to the direct current negative dimming.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are merely part of embodiments of the present invention, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

Figure 1:
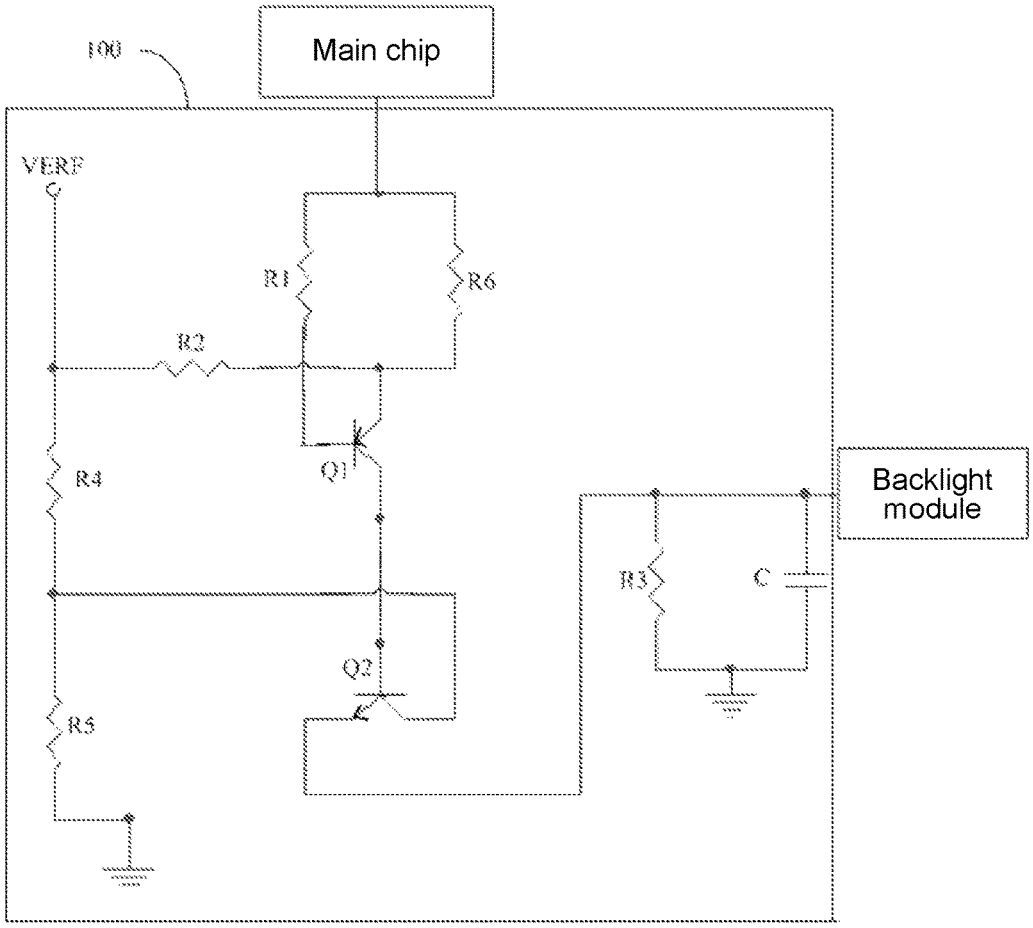
FIG. 1 is a circuit diagram of a direct current negative dimming circuit provided by the first embodiment of the present invention.

Please refer to FIG. 1. The first embodiment of the present invention provides a direct current negative dimming circuit 100. The direct current negative dimming circuit 100 is applied in a liquid crystal display device to convert a first dimming signal outputted from a main chip of the liquid crystal display device into a second dimming signal and to output the same to a backlight module.

The direct current negative dimming circuit 100 comprises a first electrical switch Q1, a second electrical switch Q2, a first resistor R1, a second resistor R2 and a third resistor R3, and a control end of the first electrical switch Q1 is connected to a dimming signal output end of the main chip through the first resistor R1 to receive the first dimming signal, and a first end of the first electrical switch Q1 is connected to a voltage end VREF through the second resistor R2 to receive a first high voltage level signal. A second end of the first electrical switch Q1 is connected to a control end of the second electrical switch Q2, and a first end of the second electrical switch Q2 is connected to a dimming signal receiving end of the backlight module to output the second dimming signal to the dimming signal receiving end, and the first end of the second electrical switch is also grounded through the third resistor R3, and a second end of the second electrical switch Q2 receives a second high voltage level signal, and a voltage level of the first dimming signal is opposite to a voltage level of the second dimming signal.

In this embodiment, the first electrical switch Q1 is a PNP type triode, and the second electrical switch Q2 is an NPN type triode, the control end, the first end and the second end of the first electric switch Q1 and the control end, the first end and the second end of the second electric switch Q2 respectively are a base, an emitter and a collector. The first high voltage level signal is less than or equal to the first dimming signal when the first dimming signal is at a high voltage level. The first electric switch Q1 is turned off.

In other embodiments, the first electric switch Q1 also can be other PNP type transistor. The second electric switch Q2 also can be other NPN type transistor.

Specifically, when the first dimming signal is at a low voltage level, the first electric switch Q1 is turned on. The voltage outputted to the control end of the second electrical switch Q2 by the first electrical switch Q1 is a high voltage level. The second electric switch Q2 is turned on. The second high voltage level signal is outputted to the dimming signal receiving end of the backlight module through the second electric switch Q2. The second high voltage level signal is the second dimming signal. When the first dimming signal is at a high voltage level, the first electrical switch Q1 is turned off, and the first electrical switch Q1 does not output signals to the control end of the second electric switch Q2. The second electric switch Q2 is turned off, and the dimming signal receiving end of the backlight module is pulled down through the third resistor R3, thus the second dimming signal is a low voltage level signal. Namely, a voltage level of the first dimming signal is opposite to a voltage level of the second dimming signal. The backlight module is bright when the dimming signal receiving end of the backlight module receives the high voltage level signal. The backlight module is dark when the dimming signal receiving end of the backlight module receives the low voltage level signal. Therefore, the first dimming signal of the main chip can be directly provided to the backlight module after being converted to the second dimming signal, thereby satisfying the requirements of the liquid crystal display device to the direct current negative dimming.

For instance, as the first high voltage level signal is a positive 5V voltage, and as the first dimming signal is a low voltage level signal 0V, the first electric switch Q1 is turned on, and the first high voltage level signal is outputted to the control end of the second electrical switch Q2 to turn on the second electrical switch Q2, and the second high voltage level signal is outputted to the dimming signal receiving end of the backlight module, i.e. the second dimming signal is a high voltage level signal. As the first dimming signal is a high voltage level signal 5V, the first electric switch Q1 is turned off, and the control end of the second electric switch Q2 is floating so that the second electric switch Q2 is turned off, and the second high voltage level signal cannot be outputted to the dimming signal receiving end of the backlight module, i.e. the second dimming signal is a low voltage level signal.

Furthermore, the direct current negative dimming circuit 100 further comprises a fourth resistor R4 and a fifth resistor R5, and the fourth resistor R4 and the fifth resistor R5 are connected in series between the voltage end VREF and a ground, and the second end of the second electrical switch Q2 is connected to a node between the fourth resistor R4 and the fifth resistor R5 to receive the second high voltage level signal.

The direct current negative dimming circuit 100 further comprises a sixth resistor R6, and the first end of the first electrical switch Q1 is connected to the dimming signal output end of the main chip through the sixth resistor R6.

Furthermore, the direct current negative dimming circuit 100 further comprises a capacitor C. The capacitor C is connected in parallel at two ends of the third resistor R3. The capacitor C acts as a filter.

A resistance of the second resistor R2 is less than a resistance of the first resistor R1 to ensure that the first electric switch Q1 is turned off when the first dimming signal is a high voltage level signal and the first high level voltage is equal to the first dimming signal.

Figure 2:
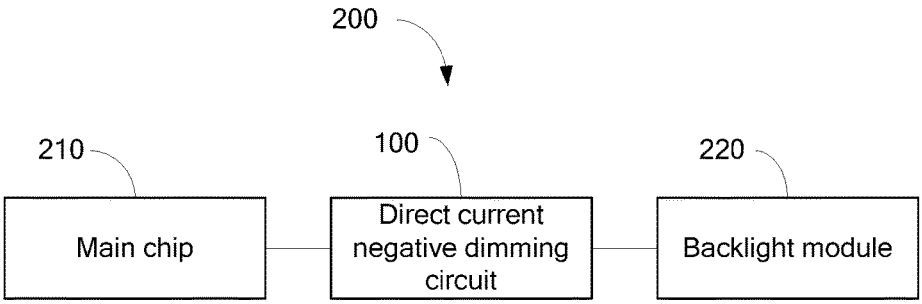
FIG. 2 is a block diagram of a liquid crystal display device provided by the second embodiment of the present invention.

Please refer to FIG. 2. The second embodiment of the present invention provides a liquid crystal display device 200. The liquid crystal display device 200 comprises a main chip 210, a backlight module 220 and a direct current negative dimming circuit. The direct current negative dimming circuit can be the direct current negative dimming circuit 100 provided by the aforesaid first embodiment. Since the direct current negative dimming circuit 100 has been described in detail in the aforesaid first embodiment, the detail description is not repeated here.

In this embodiment, the liquid crystal display device 200 also can be a liquid crystal display television. In other embodiments, the liquid crystal display device 200 also can be other liquid crystal device.

In this embodiment, the direct current negative dimming circuit 100 comprises a first electrical switch Q1, a second electrical switch Q2, a first resistor R1, a second resistor R2 and a third resistor R3, and a control end of the first electrical switch Q1 is connected to a dimming signal output end of the main chip 210 through the first resistor R1 to receive the first dimming signal, and a first end of the first electrical switch Q1 is connected to a voltage end VREF through the second resistor R2 to receive a first high voltage level signal. A second end of the first electrical switch Q1 is connected to a control end of the second electrical switch Q2, and a first end of the second electrical switch Q2 is connected to a dimming signal receiving end of the backlight module 220 to output the second dimming signal to the dimming signal receiving end and is also grounded through the third resistor R3, and a second end of the second electrical switch Q2 receives a second high voltage level signal, and when the first dimming signal is at a low voltage level, the first electric switch Q1 is turned on and the second electric switch Q2 is turned on. The second dimming signal received by the dimming signal receiving end of the backlight module 220 is the second high voltage level signal. When the first dimming signal is at a high voltage level, the first electrical switch Q1 is turned off, and the second electric switch Q2 is turned off, and the dimming signal receiving end of the backlight module 220 is pulled down through the third resistor R3, thus the second dimming signal is a low voltage level signal. Namely, a voltage level of the first dimming signal is opposite to a voltage level of the second dimming signal. The backlight module 220 is bright when the dimming signal receiving end of the backlight module 220 receives the high voltage level signal. The backlight module 220 is dark when the dimming signal receiving end of the backlight module 220 receives the low voltage level signal. Therefore, the first dimming signal of the main chip 210 can be directly provided to the backlight module 200 after being converted to the second dimming signal, thereby satisfying the requirements of the liquid crystal display device 200 to the direct current negative dimming.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. A direct current negative dimming circuit, applied in a liquid crystal display device to convert a first dimming signal outputted from a main chip of the liquid crystal display device into a second dimming signal and to output the second dimming signal to a backlight module, wherein the direct current negative dimming circuit comprises a first electrical switch, a second electrical switch, a first resistor, a second resistor and a third resistor, and a control end of the first electrical switch is connected to a dimming signal output end of the main chip through the first resistor to receive the first dimming signal, and a first end of the first electrical switch is connected to a voltage end through the second resistor to receive a first high voltage level signal, and a second end of the first electrical switch is connected to a control end of the second electrical switch, and a first end of the second electrical switch is connected to a dimming signal receiving end of the backlight module to output the second dimming signal to the dimming signal receiving end, and the first end of the second electrical switch is also grounded through the third resistor, and a second end of the second electrical switch receives a second high voltage level signal, and a voltage level of the first dimming signal is opposite to a voltage level of the second dimming signal.

2. The direct current negative dimming circuit according to claim 1, wherein the direct current negative dimming circuit further comprises a fourth resistor and a fifth resistor, and the fourth resistor and the fifth resistor are connected in series between the voltage end and a ground, and the second end of the second electrical switch is connected to a node between the fourth resistor and the fifth resistor to receive the second high voltage level signal.

3. The direct current negative dimming circuit according to claim 2, wherein the direct current negative dimming circuit further comprises a sixth resistor, and the first end of the first electrical switch is connected to the dimming signal output end of the main chip through the sixth resistor.

4. The direct current negative dimming circuit according to claim 3, wherein the direct current negative dimming circuit further comprises a capacitor, and the capacitor is connected in parallel at two ends of the third resistor.

5. The direct current negative dimming circuit according to claim 1, wherein the first electrical switch is a PNP type triode, and the second electrical switch is an NPN type triode, the control end, the first end and the second end of the first electric switch and the control end, the first end and the second end of the second electric switch respectively are a base, an emitter and a collector.

6. The direct current negative dimming circuit according to claim 1, when the first dimming signal is at a high voltage level; wherein a voltage of the first high voltage level signal is less than or equal to the voltage of the first dimming signal.

7. The direct current negative dimming circuit according to claim 1, wherein a resistance of the second resistor is less than a resistance of the first resistor.

8. A liquid crystal display device, comprising a main chip, a backlight module and a direct current negative dimming circuit, and the direct current negative dimming circuit being used to convert a first dimming signal outputted from the main chip of the liquid crystal display device into a second dimming signal and to output the second dimming signal to the backlight module, wherein the direct current negative dimming circuit comprises a first electrical switch, a second electrical switch, a first resistor, a second resistor and a third resistor, and a control end of the first electrical switch is connected to a dimming signal output end of the main chip through the first resistor to receive the first dimming signal, and a first end of the first electrical switch is connected to a voltage end through the second resistor to receive a first high voltage level signal, and a second end of the first electrical switch is connected to a control end of the second electrical switch, and a first end of the second electrical switch is connected to a dimming signal receiving end of the backlight module to output the second dimming signal to the dimming signal receiving end, and the first end of the second electrical switch is also grounded through the third resistor, and a second end of the second electrical switch receives a second high voltage level signal, and a voltage level of the first dimming signal is opposite to a voltage level of the second dimming signal.

9. The liquid crystal display device according to claim 8, wherein the direct current negative dimming circuit further comprises a fourth resistor and a fifth resistor, and the fourth resistor and the fifth resistor are connected in series between the voltage end and a ground, and the second end of the second electrical switch is connected to a node between the fourth resistor and the fifth resistor to receive the second high voltage level signal.

10. The liquid crystal display device according to claim 9, wherein the direct current negative dimming circuit further comprises a sixth resistor, and the first end of the first electrical switch is connected to the dimming signal output end of the main chip through the sixth resistor.

11. The liquid crystal display device according to claim 10, wherein the direct current negative dimming circuit further comprises a capacitor, and the capacitor is connected in parallel at two ends of the third resistor.

12. The liquid crystal display device according to claim 8, wherein the first electrical switch is a PNP type triode, and the second electrical switch is an NPN type triode, the control end, the first end and the second end of the first electric switch and the control end, the first end and the second end of the second electric switch respectively are a base, an emitter and a collector.

13. The liquid crystal display device according to claim 8, when the first dimming signal is at a high voltage level; wherein a voltage of the first high voltage level signal is less than or equal to the voltage of the first dimming signal.

14. The liquid crystal display device according to claim 8, wherein a resistance of the second resistor is less than a resistance of the first resistor.

15. The liquid crystal display device according to claim 8, wherein the liquid crystal display device is a liquid crystal display television.

* * * * *